US008048838B2

(12) United States Patent
Witteler et al.

(10) Patent No.: US 8,048,838 B2
(45) Date of Patent: Nov. 1, 2011

(54) MGDA-BASED POWDER MIXTURE OR GRANULATE MIXTURE

(75) Inventors: Helmut Witteler, Wachenheim (DE); Michael Schoenherr, Frankenthal (DE); Markus Hartmann, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 851 days.

(21) Appl. No.: 11/571,362

(22) PCT Filed: Jul. 1, 2005

(86) PCT No.: PCT/EP2005/007132

§ 371 (c)(1), (2), (4) Date: Dec. 28, 2006

(87) PCT Pub. No.: WO2006/002954

PCT Pub. Date: Jan. 12, 2006

(65) Prior Publication Data

US 2008/0045430 A1 Feb. 21, 2008

(30) Foreign Application Priority Data

Jul. 2, 2004 (DE) ..... 10 2004 032 320

(51) Int. Cl.
*C11D 7/26* (2006.01)
*C11D 7/32* (2006.01)
*C11D 7/50* (2006.01)

(52) U.S. Cl. ..... 510/224; 510/229; 510/356; 510/361; 510/475; 510/477; 510/490; 510/505; 510/506

(58) Field of Classification Search ..... 510/224, 510/229, 356, 361, 475, 477, 490, 505, 506
See application file for complete search history.

(56) References Cited

U.S. PATENT DOCUMENTS 6,162,259 A 12/2000 Williams

FOREIGN PATENT DOCUMENTS

| | | |
|---|---|---|
| DE | 198 07 104 | 8/1999 |
| DE | 199 37 345 | 2/2001 |
| EP | 0 618 289 | 10/1994 |
| EP | 0 845 456 | 6/1998 |
| EP | 0 882 786 | 12/1998 |
| EP | 0 999 264 | 5/2000 |
| JP | 10 053799 | 2/1998 |

*Primary Examiner* — Gregory Delcotto
(74) *Attorney, Agent, or Firm* — Oblon, Spivak, McClelland, Maier & Neustadt, L.L.P.

(57) ABSTRACT

A mixed powder or mixed granule containing at east 80% by weight of a mixture of (a) from 5 to 95% by weight of at least one glycine-N,N-diacetic acid derivative of the general formula (I)

$$MOOC—CHR—N(CH_2COOM)_2 \quad (I)$$

where
R is $C_{1-12}$-alkyl
M is alkali metal, (b) from 5 to 95% by weight of at least one polyethylene glycol or of at least one nonionic surfactant or of a mixture thereof or of a polymer selected from the group consisting of polyvinyl alcohols, polyvinylpyrrolidones (PVP), polyalkylene glycols and derivatives thereof, processes for producing these mixed powders or mixed granules, the use of these mixed powders or mixed granules, and a solid laundry detergent and a solid dishwasher detergent comprising the inventive mixed powder or mixed granule are described.

5 Claims, No Drawings

MGDA-BASED POWDER MIXTURE OR GRANULATE MIXTURE

The invention relates to a mixed powder or mixed granule based on glycine-N,N-diacetic acid or derivatives thereof.

To produce detergents, especially laundry detergents, or cleaning compositions especially dishwasher detergents, solid or liquid formulations may be selected. Solid formulations may be present, for example, in powder or in granule form. The production of individual pulverulent or granular detergent constituents or constituent mixtures may be difficult or impossible depending on the type of the constituents. The powders or granules rust not cake together in the course of production, in the course of mixing and in the course of storage of the compositions, and must not pair the scattering or free-flowing capability of the powder or granule.

The use of chelating agents in laundry detergents in solid form is known. WO 95/29216 relates to detergent powder compositions which comprise a metal ion-chelate complex and an anionic functional polymer. The detergent powder, comprises a complex of a chelating agent and a metal ion, selected from magnesium, calcium, strontium, zinc and aluminum, and a polymer which in particular has carboxyl groups. The powder is produced by spray-drying. The chelating agents may be selected from a multitude of compounds, but glycine-N,N-diacetic acid derivatives are not mentioned. Among the usable polymers, polycarboxylates are listed which comprise water-soluble salts of homo- and copolymers of aliphatic carboxylic acids.

EP-A-0 618 289 also relates to highly active granular detergent compositions which comprise chelates and polymers. The composition has an anionic surfactant, a chelating agent and a polymer or copolymer. The chelating agents may in turn be selected from a multitude of compounds. However, glycine-N,N-diacetic derivatives are not listed. Among the polymers, polycarboxylates in particular, such as polyacrylates, are listed.

The use of glycine-N,N-diacetic acid derivatives as complexing agents for alkaline earth and heavy metal ions in laundry detergents and cleaning compositions is described in EP-A-0 845 456. Here, the production of crystalline solids of glycine-N,N-diacetic acid derivatives (MGDA derivatives in particular is described. In this case, a specific crystallization process is employed.

Mixed powders or mixed granules based on glycine-N,N-diacetic acid, containing from 30 to 95% by weight of at least one polycarboxylate, in which up to 40 mol % of the carboxyl groups have been neutralized, are described in DE 199 37 345 A1. They are used to produce pulverulent or granular laundry detergents.

It is an object of the present invention to provide mixed powders or mixed granules comprising glycine-N,N-diacetic acid derivatives for use in solid laundry detergents and cleaning compositions. In particular, the pouring and free-flowing capability of the powders or granules should be retained.

According to the invention, the object is achieved by a mixed powder or mixed granule containing at least 80% by weight of a mixture of a) from 5 to 95% by weight of at least one glycine-N,N-diacetic acid derivative of the general formula (I)

$$MOOC—CHR—N(CH_2COOM)_2 \quad (I)$$

where
R is $C_{1-12}$-alkyl
M is alkali metal, (b) from 5 to 95% by weight of at least one polyethylene glycol or of at least one nonionic surfactant or of a mixture thereof or of a polymer selected from the group consisting of polyvinyl alcohols, polyvinylpyrrolidones (PVP), polyalkylene glycols and derivatives thereof.

The remaining proportion may be accounted for by further assistants, such as customs laundry detergent additives or fillers. The mixture preferably consists substantially, more preferably only, of the components a) and b).

In one embodiment, the mixture comprises, as component from 5 to 95% by weight of at least one polyethylene glycol or of at least one nonionic surfactant or of a mixture thereof.

It has been found in accordance with the invention that a combination of alkali metal salts of glycine-N,N-diacetic acid derivatives with at least one polyethylene glycol or at least one nonionic surfactant or a mixture thereof or a polymer selected from the group consisting of polyvinyl alcohols, polyvinylpyrrolidones (PVP), polyalkylene glycols and derivatives thereof leads to powders or granules which have a low hygroscopicity and good storage performance, and can therefore be used advantageously in solid laundry detergents and cleaning compositions. The compositions are very storage-stable and still pourable and free-flowing even after long periods.

Compared to mixtures of glycine-N,N-diacetic acid derivatives with polycarboxylates, there is the advantage that the abovementioned mixtures feature an improved free-flowing capability.

Glycine-N,N-diacetic acid derivatives which can be used in accordance with the invention are described, for example, in EP-A-0 845 456. Suitable glycine-N,N-diacetic acid derivatives are accordingly compounds of the general formula (I)

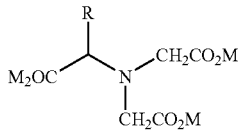

(I)

in which
R is $C_1$- to $C_{12}$-alkyl and
M is alkali metal.

In the compounds of the general formula (I), M is an alkali metal, preferably sodium or potassium, more preferably sodium.

R is a $C_{1-12}$-alkyl radical, preferably a $C_{1-6}$-alkyl radical, more preferably a methyl or ethyl radical. The component (a) used is more preferably an alkali metal salt of methylglycinediacetic acid (MGDA). Very particular preference is given to using the trisodium salt of methylglycinediacetic acid.

The preparation of such glycine-N,N-diacetic acid derivatives is known; cf. EP-A-0 845 456 and literature cited therein.

The component (b) used is at least one polyethylene glycol or at least one nonionic surfactant or a mixture thereof, or a polymer selected from the group consisting of polyvinyl alcohols, polyvinylpyrrolidones (PVP), polyalkylene glycols and derivatives thereof.

The component (b) used is preferably a polyethylene glycol, more preferably having an average molecular weight (weight-average molecular weight) of from 500 to 30 000 g/mol.

In a preferred embodiment, the polyethylene glycol used as component (b) has OH end groups and/or $C_{1-6}$-alkyl end groups. The component (b) used in the inventive mixture is more preferably a polyethylene glycol which has OH and/or methyl end groups.

The polyethylene glycol used in the inventive mixture preferably has a molecular weight (weight-average molecular weight) of from 1000 to 5000 g/mol, most preferably from 1200 to 2000 g/mol.

Suitable compounds which can be used as component (b) are nonionic surfactants. These are preferably selected from the group consisting of alkoxylated primary alcohols, alkoxylated fatty alcohols, alkylglycosides, alkoxylated fatty acid alkyl esters, amine oxides and polyhydroxy ratty acid amides.

The nonionic surfactants used are preferably alkoxylated, advantageously ethoxylated, in particular primary alcohols having preferably from 8 to 18 carbon atoms and on average from 1 to 12 mol of ethylene oxide (EO) per mole of alcohol, in which the alcohol radical may be linear or preferably 2-methyl-branched, or may contain a mixture of linear and branched radicals, as are typically present in oxo alcohol radicals. However, especially preferred alcohol ethoxylates have linear radicals of alcohols of native origin having from 12 to 18 carbon atoms, for example of coconut, palm, tallow fat or oleyl alcohol, and on average from 2 to 8 EO per mole of alcohol. The preferred ethoxylated alcohols includes for example, $C_{12-14}$-alcohols having 3 EO, 4 EO or 7 EO, $C_{9-11}$-alcohols having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3 EO and $C_{12-18}$-alcohol having 7 EO. The degrees of ethoxylation specified are statistical average values which may be an integer or a fraction for a specific product. Preferred alcohol ethoxylates have a narrowed homolog distribution (narrow range ethoxylates, NRE).

In addition to these nonionic surfactants, it is also possible to use fatty alcohols having more than 12 EO. Examples thereof are tallow fat alcohols having 14 EO, 25 EO, 30 EO or 40 EO. It is also possible in accordance with the invention to use nonionic surfactants which contain EO and PO groups together in the molecule. In this context, block copolymers having EO-PO block units or PO-EO block units may be used, but also b EO-PO-EO copolymers or PO-EO-PO copolymers. It will b e appreciated that it is also possible to use nonionic surfactants having mixed alkoxylation, in which EO and PO units are not distributed in blocks but rather randomly. Such products are obtainable by simultaneous action of ethylene oxide and propylene oxide on fatty alcohols.

In addition, further nonionic surfactants which may be used are also alkyl glycosides of the general formula RO(G) in which R is a primary straight-chain or methyl-branched, in particular 2-methyl-branched, aliphatic radical having from 8 to 22, preferably from 12 to 18, carbon atoms and is the symbol which represents a glycose unit having 5 or 6 carbon atoms, preferably glucose. The degree of oligomerization x, which specifies the distribution of monoglycosides, and oligoglycosides, is any number between 1 and 10; x is preferably from 1.2 to 1.4.

A further class of nonionic surfactants used with preference, which are used either as these sole nonionic surfactant or in combination with other nonionic surfactants, is that of alkoxylated, preferably ethoxylated or ethoxyloxylated, fatty acid alkyl esters, preferably having from 1 to 4 carbon atom in the alkyl chain, in particular fatty acid methyl esters.

Nonionic surfactants of the amine oxide type, for example N-tallow alkyl-N,N-dihydroxyethylamine oxide, and of the fatty acid alkanolamide type may also be suitable. The amount of these nonionic surfactants is preferably not more than that of the ethoxylated fatty alcohols, in particular not more than half thereof.

Further nonionic surfactants are polyhydroxy fatty acid amides of the formula (II)

(II)

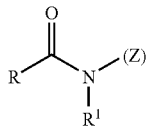

in which RC═O is an aliphatic acyl radical having from 6 to 22 carbon atoms, $R^1$ is hydrogen, an alkyl or hydroxyalkyl radical having from 1 to 4 carbon atoms and (Z) is a linear or branched polyhydroxyalkyl radical having from 3 to 10 carbon atoms and from 3 to 10 hydroxyl groups. The polyhydroxy fatty acid amides are known substances which can typically be obtained by reductively aminating a reducing sugar with ammonia, an alkylamine or an alkanolamine, and subsequently acylating with a fatty acid, a fatty acid alkyl ester or a fatty acid chloride.

The group of polyhydroxy fatty acid amides also includes compounds of the formula (III)

(III)

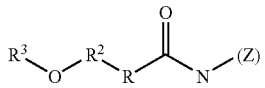

in which R is a linear or branched alkyl or alkenyl radical having from 7 to 12 carbon atoms, $R^2$ is a linear, branched or cyclic alkyl radical or an aryl radical having from 2 to 3 carbon atoms and $R^3$ is a linear, branched or cyclic alkyl radical or an aryl radical or an oxyalkyl radical having from 1 to 8 carbon atoms, preference being given to $C_{1-4}$-alkyl or phenyl radicals, and (Z) is a linear polyhydroxyalkyl radical whose alkyl chain is substituted by at least two hydroxyl groups, or alkoxylated, preferably ethoxylated or propoxylated, derivatives of this radical. (Z) is preferably obtained by reductive a sugar, for example glucose, fructose maltose, lactose, galactose, mannose or xylose. The N-alkoxy- or N-aryloxy-substituted compounds can be converted to the desired polyhydroxy fatty acid amides by reaction with fatty acid methyl esters in the presence of a catalyst.

Preference is given to using low-foaming nonionic surfactants which have a melting point above room temperature. Accordingly, preferred mixtures comprise nonionic surfactant(s) with a melting point above 20° C., preferably above 25° C., more preferably from 25 to 100° C. and especially preferably from 30 to 50° C.

Suitable nonionic surfactants which have melting and softening points within the temperature range specified are, for example, relatively low-foaming nonionic surfactants which may be solid or highly viscous at room temperature. When nonionic surfactants which have a high viscosity at room temperature are used, they preferably have a viscosity above 20 Pas, preferably and in particular above 40 Pas. Nonionic surfactants which have a waxlike consistency at room temperature are also preferred.

Nonionic surfactants which are solid at room temperature and are to be used with preference stem from the groups of alkoxylated nonionic surfactants, in particular the ethoxylated prima alcohols and mixtures of these surfactants with structurally complex surfactants, such as polyoxypropylene/polyoxyethylene, polyoxypropylene (PO/EO/PO) surfactants. Such (PO/EO/PO) nonionic surfactants are additionally notable for good foam control.

In a preferred embodiment of the present invention, the nonionic surfactant with a melting point above room temperature is an ethoxylated nonionic surfactant which has resulted from the reaction of a monohydroxyalkanol or alkylphenol having from 6 to 20 carbon atoms with preferably at least 12 mol, more preferably at least 15 mol, in particular at least 20 mol, of ethylene oxide per mole of alcohol or alkylphenol.

A nonionic surfactant which is solid at room temperature and is to be used with particular preference is obtained from a straight-chain fatty alcohol having from 16 to 20 carbon atoms ($C_{16-20}$-alcohol), preferably a $C_{18}$-alcohol, and at least 12 mol, preferably at least 15 mol and in particular at least 20 mol, of ethylene oxide. Of these, the "narrow range ethoxylates" (see above) particularly preferred.

Accordingly, particularly preferred inventive mixtures comprise ethoxylated nonionic surfactants) which has/have been obtained from $C_{6-20}$-monohydroxyalkanols or $C_{6-20}$-akylphenols or $C_{16-20}$-fatty alcohols and more than 12 mol, preferably more than 15 mol and in particular more than 20 mol, of ethylene oxide per mole of alcohol.

The nonionic surfactant preferably additionally has propylene oxide units in the molecule. Preferably, such PO units make up to 25% by weight, more preferably up to 20% by weight and in particular up to 15% by weight, of the total molar mass of the nonionic surfactant. Particularly preferred non ionic surfactants are ethoxylated monohydroxyalkanols or alkylphenols which additionally have polyoxyethylene-polyoxy-propylene block copolymer units. The alcohol or alkylphenol moiety of such nonionic surfactant molecules preferably makes up more than 30% by weight, more preferably more than 50% by weight and in particular more than 70% by weight, of the total molar mass of such nonionic surfactants. Preferred rinse aids comprise ethoxylated and propoxylated nonionic surfactants in which the propylene oxide units in the molecule make up to 25% by weight, preferably up to 20% by weight and in particular up to 15% by weight, of the total molar mass of the nonionic surfactant.

Further nonionic surfactants which have melting points above room temperature and are to be used with particular preference contain from 40 to 70% of a polyoxypropylene/polyoxyethylene/polyoxypropylene block polymer blend which 75% by weight of an inverse block copolymer of polyoxyethylene and polyoxypropylene having 17 mol of ethylene oxide and 44 mol of propylene oxide, and 25% by weight of a block copolymer of polyoxyethylene and polyoxypropylene initiated with trimethylolpropane and containing 24 mol of ethylene oxide and 99 mol of propylene oxide per mole or trimethylolpropane.

The inventive mixture comprises, as a fu her preferred nonionic surfactant, a compound of the formula (IV)

$$R^4O[CH_2CH(CH_3)O]_x[CH_2CH_2O]_y[Ch_2CH(OH)R^5] \quad (IV)$$

in which $R^4$ is a linear or branched aliphatic hydrocarbon radical having from 4 to 18 carbon atoms or mixtures thereof, $R^5$ is a linear or branched hydrocarbon radical having from 2 to 4 carbon atoms or mixtures thereof, and x is from 0.5 to 1.5, and y is at least 15.

Further nonionic surfactants which can be used with preference are the end group-capped poly(oxyalkylated) nonionic surfactants of the formula (V)

$$R^6O[CH_2CH(R^8)O]_z[CH_2]_kCH(OH)[CH_2]_jOR^7 \quad (V)$$

in which $R^6$ and $R^7$ are linear or branched, saturated or unsaturated, aliphatic or aromatic hydrocarbon radicals having from 1 to 30 carbon atoms, $R^8$ is hydrogen or a methyl, ethyl, n-propy, isopropyl, n-butyl, n-butyl or 2-methyl-2-butyl radical, z is from 1 to 30, k and j are from 1 to 12, preferably from 1 to 5. When z is ≧2, each $R^8$ in formula (V) may be different, $R^6$ and $R^7$ are preferably linear or branched, saturated or unsaturated, aliphatic or aromatic hydrocarbon radicals having from 6 to 22 carbon atoms, particular preference being given to radicals having from 8 to 18 carbon atoms. For the $R^8$ radical, particular preference is given to hydrogen, methyl or ethyl. Particularly preferred values for z are in the range from 1 to 20, in particular from 6 to 15.

As described above, each $R^8$ in formula (V) may be different if z is ≧2. This allows the alkylene oxide unit in the square brackets to be varied. When z is, for example, 3, the $R^8$ radical may be selected so as to form ethylene oxide ($R^8$=H) or propylene oxide ($R^8$=$CH_3$) units which can be joined together in any sequence, for example (EO)(PO)EO), (EO)(EO)(PO), (EO)(EO)(EO), (PO)(EO)(PO), (PO)(PO)(EO) and (PO)(PO)(PO). The value 3 for z has been selected here by way of example and it is entirely possible for it to be larger, the scope of variation increasing with increasing z values and embracing, for example, a large number of EO groups combined with a small number of PO groups, or vice versa.

Especially preferred end group-capped poly(oxyalkylated) alcohols of the formula (V) have values of k=1 and j=1, so that the formula V) is simplified to formula (VI):

$$R^6O(CH_2CH(R^8)_2CH_2CH(OH)CH_2OR^7 \quad (VI)$$

In formula (VI), $R^6$, $R^7$ and $R^8$ are each as defined in formula (V) and z is from 1 to 30, preferably from 1 to 20 and in particular from 6 to 18. Particular preference is given to surfactants in which the $R^6$ and $R^7$ radicals each have from 9 to 14 carbon atoms, $R^8$ is hydrogen and z assumes values of from 6 to 15.

If the latter statements are summarized, preference is given to inventive mixtures which comprise, as nonionic surfactants, end group-capped poly(oxyalkylated) compounds of the formula (V) in which $R^6$ and $R^7$ are linear or branched, saturated or unsaturated, aliphatic hydrocarbon radicals having from 1 to 30 carbon atoms, $R^8$ is hydrogen or a methyl, ethyl, n-propyl, isopropyl, n-butyl, 2-butyl or 2-methyl-2-butyl radical, z is from 1 to 30, k and j are from 1 to 12, preferably from 1 to 5, particular preference being given to surfactants of the formula (VI) in which z is from 1 to 30, preferably from 1 to 20 and in particular from 6 to 18.

Very particular preference is given to nonionic surfactants being present in the inventive mixture as component (b) which are obtainable under the trade name Pluronic from BASF AG.

The proportion of component (a) is from 5 to 95% by weight, preferably from 40 to 60% by weight. An example of a proportion of component (a) is 50% by weight. Correspondingly, component (b) is present in an amount of from 5 to 95% by weight, preferably from 40 to 60% by weight. An example is an amount of 50% by weight.

The inventive mixed powders or mixed granules may be produced by mixing the two components as a powder and subsequently heating the mixture, especially to a temperature above the melting or softening point of component (b). This melts component (b) which mixes intimately with component (a). In the subsequent cooling and shaping process, the powder properties such as particle size and bulk density are adjusted.

The present invention also relates to a process for producing the inventive mixed powders or mixed granules by mixing components (a) and (b) as a powder, heating the mixture and adjusting the powder properties in the subsequent cooing and shaping process.

It is also possible to granulate component (a) with the already molten component (b) and subsequently to cool it.

In the event of suitable (a)/(b) mixture ratios, it is also possible to stir component (a) into the melt of component (b). The subsequent solidification and shaping is effected in accordance with the known processes of melt processing, for example by prilling or on cooing belts with, if required, subsequent steps for adjusting the powder properties, such as grinding and sieving.

The inventive mixed powders or mixed granules may also be produced by dissolving components (a) and (b) in a solvent and spray-drying the resulting mixture, which may be followed by a granulation step. In this process, components (a) and (b) may be dissolved separately, in which case the solutions are subsequently mixed, or a powder mixture of the components may be dissolved in water. Useful solvents are all of those which can dissolve components (a) and (b); preference is given to using, for example, alcohols and/or water, particular preference to using water.

The present invention thus also relates to a process for producing the inventive mixed powders or mixed granules by dissolving components (a) and (b) in a solvent and spray-drying the resulting mixture, which may be followed by a granulation step and/or a melt granulation step see above).

The present invention also relates to the use of the inventive mixed powders or mixed granules for producing solid laundry detergents and cleaning compositions, for the laundering of textiles or for the cleaning of tableware and kitchenware. As mixed powders or mixed granules, both components develop an action in laundry detergents and cleaning compositions, for example as dishwasher compositions for machine dishwashers.

The mixed powders or mixed granules may be incorporated into pulverulent laundry detergents and cleaning compositions, without these forming lumps or caking.

The invention also relates to a solid cleaning composition comprising a mixed powder or mixed granule as described above and, if appropriate, at least one further surfactant. Suitable cleaning compositions are known and are described, for example, in WO 95/29216 and EP-A-0 618 289.

The invention further relates to a solid dishwasher detergent which comprises a mixed powder or mixed granule as described above and additionally, if appropriate, at least one (further) surfactant. The compositions are preferably in powder or granule form.

The invention is illustrated in detail below with reference to examples.

EXAMPLES

The component (a) used was methylglycinediacetic acid (MGDA) in the form of the trisodium salt. The component (b) used was polyethylene glycol having a molecular weight of approx. 1500 g/mol (PEG 1500.

The inventive mixture was produced by melt-blending a mixture of MGDA and the polyethylene glycol.

To determine the hygroscopicity and the storage performance, the weight increase was determined at 20° C. and 68% relative humidity for a period of 24 hours. It was investigated whether the product was free-flowing (F), solid and not free-flowing (S) or tacky and not free-flowing (T). The results for the inventive mixtures are summarized in the table below. The abbreviation r.h. means relative humidity.

TABLE

| MGDA:PEG 1500 mixing ratio | Hygroscopicity (20° C./68% r.h.; 24 h) | Free-flowing capability ("good/poor") | pH of an aqueous solution (1%) |
|---|---|---|---|
| 50% by wt. of MGDA:50% by wt. of PEG 1500 | 1.9% | F (highly free-flowing) | 11.5 |
| 66% by wt. of MGDA:33% by wt. of PEG 1500 | 6.1% | F (free-flowing) | 11.2 |
| 75% by wt. of MGDA:25% by wt. of PEG 1500 | 6.5% | F (free-flowing) | 11.2 |
| 100% by wt. of MGDA | 8.2% | T (not free-flowing) | 11.7 |

It is evident from the results of the table above that the present inventive mixtures with the specified contents of component (a) and (b) have a very low hygroscopicity and remain free-flowing even after a prolonged storage time.

What is claimed is:

1. A mixed powder or mixed granule consisting of (a) from 5 to 95% by weight of at least one glycine-N,N-diacetic acid derivative of the general formula (I)

$$MOOC—CHR—N(CH_2COOM)_2 \quad (I)$$

where

R is $C_{1-12}$-alkyl

M is alkali metal, and (b) from 5 to 95% by weight of at least one polyethylene glycol having OH and/or methyl end groups.

2. The mixed powder or mixed granule according to claim 1, wherein component (a) is an alkali metal salt of methylglycine diacetic acid.

3. The mixed powder or mixed granule according to claim 1, wherein the polyethylene glycol in component (b) has a weight average molecular weight of from 500 to 30,000 g/mol.

4. The mixed powder or mixed granule according to claim 1, wherein the polyethylene glycol in component (b) has OH end groups.

5. The mixed powder or mixed granule according to claim 1, wherein the polyethylene glycol in component (b) has methyl end groups.

* * * * *